US006111230A

United States Patent [19]

Cao et al.

[11] Patent Number: 6,111,230

[45] Date of Patent: Aug. 29, 2000

[54] METHOD AND APPARATUS FOR SUPPLYING AC POWER WHILE MEETING THE EUROPEAN FLICKER AND HARMONIC REQUIREMENTS

[75] Inventors: Jichang Cao; Timothy Allen Green, both of Lexington; Steven Jeffrey Harris, Frankfort; Ronald Todd Sellers, Lexington, all of Ky.

[73] Assignee: Lexmark International, Inc., Lexington, Ky.

[21] Appl. No.: 09/314,766

[22] Filed: May 19, 1999

[51] Int. Cl.[7] ..... H05B 1/02

[52] U.S. Cl. ..... 219/501; 219/216; 219/497; 219/492; 323/236; 399/69

[58] Field of Search ..... 219/501, 216, 219/497, 505, 507, 508, 494, 492; 323/235, 236, 319; 399/70, 69

[56] References Cited

U.S. PATENT DOCUMENTS

| | | | |
|---|---|---|---|
| 3,859,591 | 1/1975 | Saunders . | |
| 3,959,714 | 5/1976 | Mihelich . | |
| 4,251,752 | 2/1981 | Stolz . | |
| 4,307,440 | 12/1981 | Inoue | 363/15 |
| 4,334,147 | 6/1982 | Payne . | |
| 4,461,990 | 7/1984 | Bloomer | 323/235 |
| 4,493,984 | 1/1985 | Yamauchi . | |
| 4,568,858 | 2/1986 | Matsui . | |
| 4,900,900 | 2/1990 | Shirae et al. . | |
| 5,079,409 | 1/1992 | Takada et al. . | |
| 5,483,149 | 1/1996 | Barrett . | |
| 5,600,406 | 2/1997 | Aikawa et al. . | |
| 5,669,038 | 9/1997 | Kishimoto . | |
| 5,708,920 | 1/1998 | Ohnishi et al. . | |
| 5,789,723 | 8/1998 | Hirst . | |
| 5,796,245 | 8/1998 | Beaulieu et al. . | |

*Primary Examiner*—Mark Paschall
*Attorney, Agent, or Firm*—John A. Brady

[57] ABSTRACT

An improved control method is provided that combines conventional ON-OFF control and conventional phase-angle control to reduce the AC inrush current to an electrical load, such as a tungsten halogen lamp used as a heating element in a laser printer, so that the power control circuit can satisfy both the European flicker and European harmonic requirements. Phase-angle control is applied to the load for a very short time period when it is initially energized, then the control circuit quickly switches from phase-angle control to standard ON-OFF control to reduce the harmonics generated by conventional phase-angle control methodologies. The electrical load exhibits three possible states: power full OFF, power ramp-up, and power full ON. During the power ramp-up state, power supplied to the load is adjusted by delaying the phase angle of the firing pulse relative to the start of each AC half cycle. Depending upon whether or not the system demand has been satisfied, the load's state can be changed from either power ramp-up to power full ON, or from power ramp-up to power full OFF. The phase-angle control methodology used during the power ramp-up state must be of sufficient time duration to reduce the amount of flicker to pass the European flicker test. However, this power ramp-up time interval must also be as short as possible to keep the harmonics as small as possible to the load, without the requirement of adding a large AC current harmonic attenuation inductor, which would otherwise be needed to pass the European harmonic test.

20 Claims, 5 Drawing Sheets

METHOD AND APPARATUS FOR SUPPLYING AC POWER WHILE MEETING THE EUROPEAN FLICKER AND HARMONIC REQUIREMENTS

TECHNICAL FIELD

The present invention relates generally to electrical equipment sold in Europe and is particularly directed to an alternating current power profile that meets the European flicker and harmonic requirements. The invention is specifically disclosed as a dual mode AC power supply that uses phase-angle control during a start mode and later runs at continuous full power during a running mode.

BACKGROUND OF THE INVENTION

In Europe there are new noise reduction requirements for all electrical and electronic equipment that will be sold in the near future, and two of these requirements are known as the "harmonic" requirement IEC 61000-3-2, and the "flicker" requirement IEC 61000-3-3. Laser printers contain a high wattage heating element, such as a 750 W tungsten-filament lamp, which are used to provide heat to the fuser. When alternating current electrical power is first provided to such high-wattage lamps, there is typically a large inrush current that primarily produces harmonic noise and an instantaneous voltage drop that can affect other electrical equipment connected on the same or a nearby electrical branch circuit.

For example, previous laser printers manufactured by Lexmark International, Inc. used a strictly ON-OFF control system to control the fuser temperature by turning the high-wattage lamp either full ON or full OFF. A tungsten halogen lamp has typically been used to act as this heating element, which acts as a nonlinear load, and which will observe a quite high inrush current when the lamp is first turned on under the prior control circuits. For example, if the lamp undergoes a "cold start," the resistance characteristic of a standard 750 W tungsten halogen lamp filament is around 5.2 ohms at 25° C. However, when the lamp is burning at a full ON steady state, at about 2000° C., its resistance is about 64.5 ohms while providing a 750 W output.

The low filament resistance when started from a "cold start" results in a light flicker for electrical light bulbs that are previously energized on the same or a nearby branch circuit.

To satisfy the European flicker requirement, one alternative is to use a phase-angle control method to provide power to the tungsten-filament lamp so as to gradually increase the amount of current that flows through the lamp filament when it is cold and is initially being energized. The advantage of the phase-angle control is that the power supplied to the load can be initially reduced by delaying the firing pulse of the output stage triac relative to the starting of each half cycle of AC voltage. However, phase control also introduces significant distortion of the sine wave that normally represents the AC current waveform. A distorted current waveform can cause many undesirable effects on the AC power supply, thus leading to a failure of the equipment to comply with the European harmonic requirement.

To meet this European harmonic requirement while using a phase-angle controller, a large AC harmonic attenuation inductor has been placed in series with the tungsten halogen lamp in conventional designs. Unfortunately, this relatively large inductor dramatically increases the cost of the product, and additionally causes an uncomfortable humming noise when the lamp is turned on. In the past, no practical solution has been found to completely eliminate the inductor humming noise.

SUMMARY OF THE INVENTION

Accordingly, it is a primary advantage of the present invention to energize an electrically-driven apparatus with a combination of controlled power modes to meet both the European "harmonic" requirement and the "flicker" requirement.

It is another advantage of the present invention to energize an electrically-driven apparatus by initially increasing the power provided to the apparatus using phase-angle control at a ramp-up rate that is gradual enough to meet the European "flicker" requirement, and thereafter reaching full power quickly enough to meet the European "harmonic" requirement without the use of a large AC harmonic attenuation inductor.

It is a further another advantage of the present invention to energize an electrically-driven apparatus by initially providing very little power to the apparatus during an initial AC line voltage half cycle using phase-angle control in which the first pulse of AC power is delayed by nearly the entire half cycle, then decreasing the time delay at a predetermined rate before pulsing the apparatus during each subsequent half cycle until reaching full power; and thereafter entering a full ON power mode.

It is yet another advantage of the present invention to energize an electrically-driven apparatus by initially providing very little power to the apparatus during an initial AC line voltage half cycle using phase-angle control in which the first pulse of AC power is delayed by use of a down counter that is loaded with a numeric value that represents a time interval nearly equal to the entire half cycle, then decreasing the time delay at a predetermined rate, by loading the down counter with a predetermined lesser numeric value, before pulsing the apparatus during each subsequent half cycle, until the numeric value reaches zero, which represents full power; and thereafter entering a full ON power mode in which the down counter is loaded with a numeric value of zero (0) for all subsequent half cycles.

It is still another advantage of the present invention to energize an electrically-driven printer by initially providing very little power to the fuser's heating element during an initial AC line voltage half cycle using phase-angle control in which the first pulse of AC power is delayed by use of a down counter that is loaded with a numeric value that represents a time interval nearly equal to the entire half cycle; then (1) decreasing the time delay at a first predetermined rate in a printing mode, by loading the down counter with a predetermined lesser numeric value of one quantity, before pulsing the fuser heating element during each subsequent half cycle, until the numeric value reaches zero, which represents full power; and thereafter entering a full ON power mode in which the down counter is loaded with a numeric value of zero (0) for all subsequent half cycles; or (2) decreasing the time delay at a second predetermined rate in a standby mode, by loading the down counter with a predetermined lesser numeric value of a different smaller quantity, before pulsing the fuser heating element during each subsequent half cycle, until the numeric value reaches zero, which represents full power; and thereafter entering a full ON power mode in which the down counter is loaded with a numeric value of zero (0) for all subsequent half cycles.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an improved control method is provided that combines conventional ON-OFF control and conventional phase-angle control to reduce the AC inrush current to an electrical load, such as a tungsten halogen lamp, so that the power control circuit can satisfy both the European flicker and European harmonic requirements, while also eliminating the need for a large in-series inductor. Phase-angle control is applied to the load for a very short time period when it is initially energized, then the control circuit quickly switches from phase-angle control to standard ON-OFF control to reduce the harmonics generated by conventional phase-angle control methodologies. The electrical load exhibits three possible states: (1) power full OFF, (2) power ramp-up, and (3) power full ON.

During the power ramp-up state, power supplied to the load is adjusted by delaying the firing pulse relative to the start of each AC half cycle. Depending upon whether or not the system demand has been satisfied, the load's state can be changed from either power ramp-up to power full ON, or from power ramp-up to power full OFF. If the system demand has not been satisfied during the power ramp-up state, the load will be turned full ON to reach and maintain the system's process variable (e.g., a fusing temperature of a laser printer) under ON-OFF control. On the other hand, if the system demand is satisfied during either power ramp-up or during the power full ON state, the load will be immediately turned OFF to reduce overshoot of the process variable. The phase-angle control methodology used during the power ramp-up state must be of sufficient time duration to reduce the amount of flicker to pass the European flicker test. However, this power ramp-up time interval must also be as short as possible to keep the harmonics as small as possible to the load, without the requirement of adding a large AC current harmonic attenuation inductor, which would otherwise be needed to pass the European harmonic test.

One beneficial effect of the methodology of the present invention is that, when used with a heating element or lamp filament as the electrical load, power is gradually supplied to the load when the filament or heating element is relatively cold (and exhibits a low resistance), so that the filament or heating element is pre-heated during the power ramp-up, which will have the effect of increasing the filament's or heating element's resistance to its steady state value. Once the filament's or heating element's resistance reaches its steady state value, full power is applied to the load until the process variable is satisfied at its upper control limit, after which power is turned completely OFF to reduce temperature overshoot.

A computer program is preferably used to repeatedly inspect the process variable so as to determine if the system demand is being satisfied. This computer program also controls the phase-angle firing of the current being supplied to the load during the ramp-up interval, and the program preferably runs repetitively at intervals of about one half cycle period of the AC power being supplied to the circuit. In a preferred embodiment disclosed herein, the computer program loads a numeric value into a down-counter, and this numeric value is proportional to the amount of time delay before firing the output triac during each AC line voltage half cycle after a zero crossing is detected. The initial counter numeric value is equivalent to almost the entire half cycle period, so that very little power is applied to the load during that initial half cycle. After the first (initial) half cycle, the counter's numeric value is somewhat decreased or decremented so as to cause a somewhat lesser time delay before firing the output triac after a zero crossing, thereby somewhat increasing the power applied to the load for that half cycle. This decreasing the counter's numeric value continues for each successive half cycle until full power is achieved (which occurs when the count value is zero, implying a zero time delay before firing the output triac), after which the control circuit leaves the ramp-up mode and enters a full ON state.

When the present invention is used in a laser printer's fuser heating element circuit, the best printer performance is achieved by providing two different power ramp-up profiles for different printer machine states. These states are "standby" and "printing." In the printing state, the fuser temperature response is sufficiently critical, especially when printing on heavy print media in cold and wet environments, that the power supplied to the lamp must be increased quickly enough to achieve a satisfactory temperature response. Therefore, the ramp-up time interval in the printing state of the present invention is selected so as to be achieved very quickly, at least in comparison to the ramp-up time interval for the standby state.

The power ramp-up interval is also referred to as the "power increment time." The other time quantities that must be considered with respect to the European standards are referred to as a "harmonic time limit" and a "flicker time limit." For a printer without a large AC harmonic attenuation inductor to be able to pass the European harmonic test, the power increment time must be smaller than the harmonic time limit. The harmonic time limit thus represents an upper bound of the power increment time, and this harmonic time limit is determined by the European harmonic standard, the printer's heating element wattage, and the fuser's operating temperature. The flicker time limit serves as a lower bound of the power increment time, since a printer having a power increment time that is shorter in duration than the flicker time limit will fail to pass the European flicker test. The flicker time limit also is determined by the printer's heating element wattage and fuser's operating temperature, as well as the European flicker standard.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
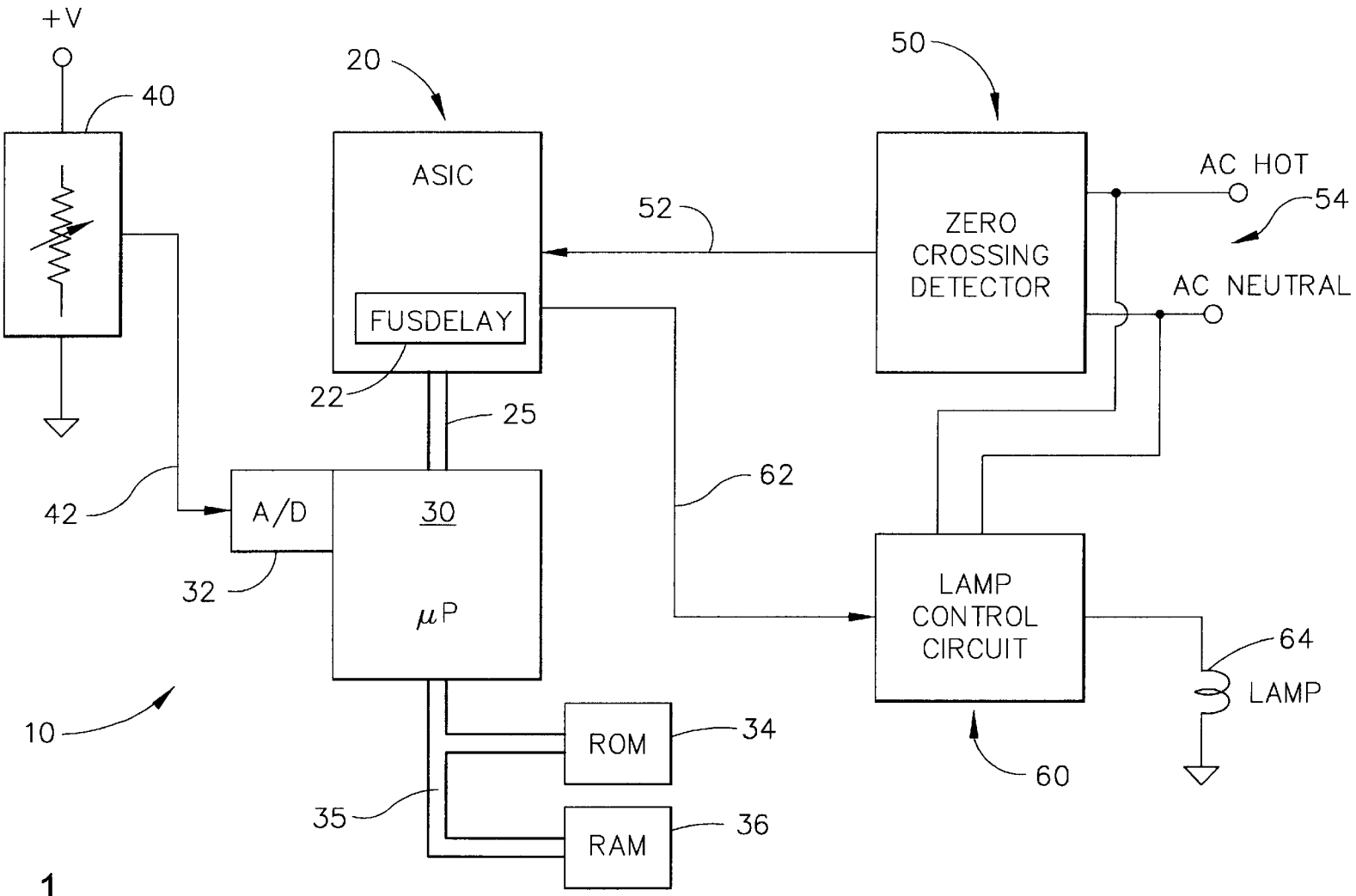
FIG. 1 is a block diagram of the major components of a print engine, as related to the present invention.

Referring now to the drawings, FIG. 1 a block diagram of some of the major components of a print engine for a laser printer, as constructed according to the principles of the present invention. An Application Specific Integrated Circuit (ASIC), generally designated by the reference numeral 20, includes a register called "FUSDELAY" at 22. This FUSDELAY register 22 is loaded with a numeric value from a microprocessor 30, over a digital bus 25. Microprocessor 30 also is in communication with Read Only Memory (ROM) 34 and Random Access Memory (RAM) 36, connected through a combined address and data bus 35.

Microprocessor 30 preferably comprises a microcontroller integrated circuit which includes an on-board analog-to-digital converter illustrated on FIG. 1 as "A/D" 32. This A/D converter 32 receives an analog signal over a pathway 42 from a thermistor circuit 40. This thermistor circuit provides an indication of the actual temperature of the fuser (not shown) of the print engine, and preferably comprises a voltage divider network of which the thermistor is one component.

A power source of alternating current is provided at 54 into a zero crossing detector circuit 50. Zero crossing detector 50 outputs a logic level signal along a signal pathway 52 into ASIC 20. ASIC 20 outputs a logic level signal called "HEATON" along a signal pathway 62. This HEATON signal controls a lamp control circuit 60, which outputs an alternating current signal (i.e., the power itself) to a tungsten halogen lamp 64. Lamp control circuit 60 is capable of controlling the turning ON phase angle of the current being supplied to lamp 64, and thereby can control the amount of power being supplied to lamp 64.

Figure 2:
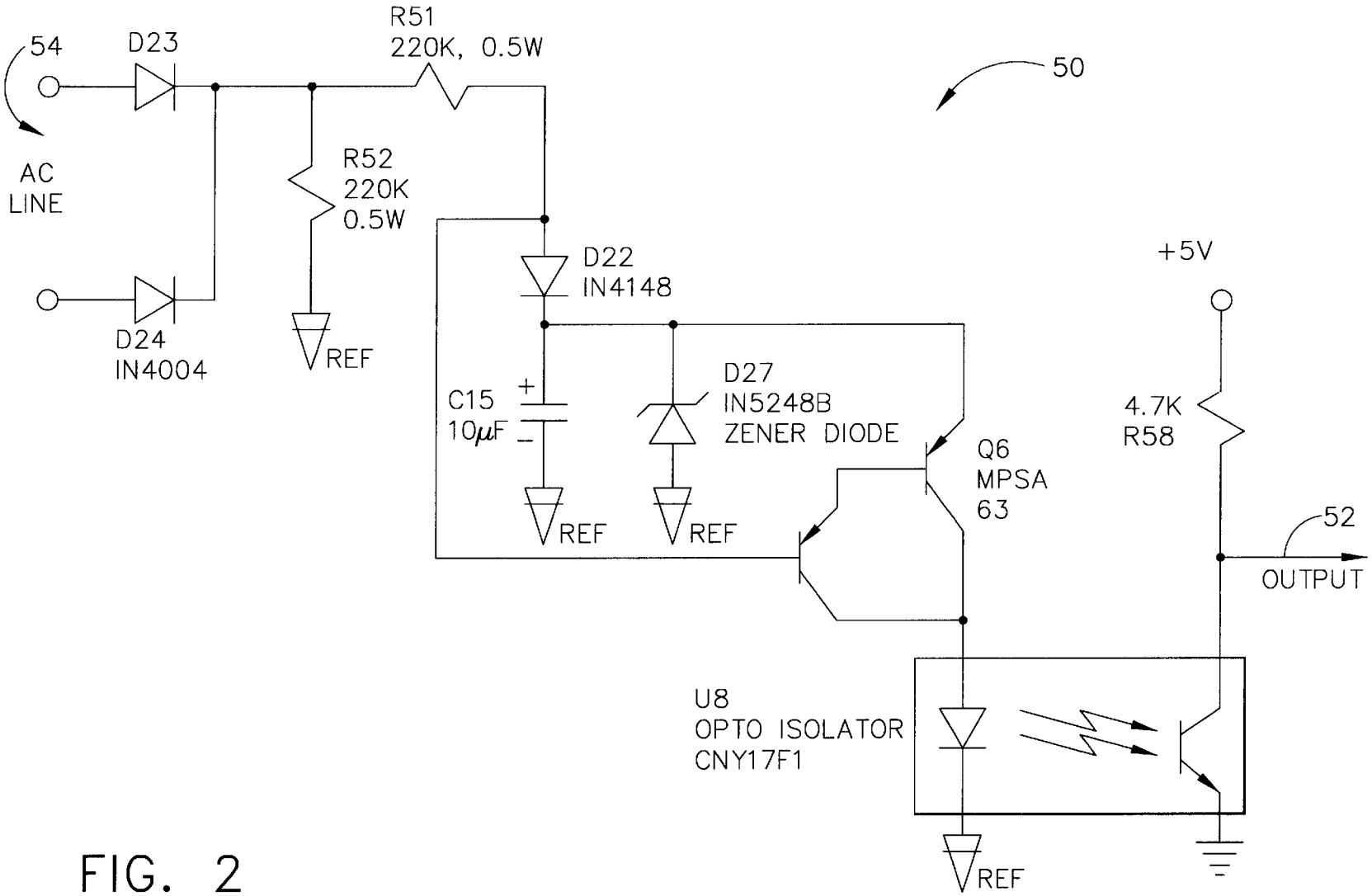
FIG. 2 is a schematic diagram of the electrical components used in a zero crossing detector, as constructed according to the principles of the present invention.

The individual electrical components of zero crossing detector 50 are illustrated on FIG. 2, in the form of a schematic diagram. The output 52 of zero crossing detector 50 provides a negative-going pulse (at about 0 VDC) that indicates the timing of a zero crossing of the AC line voltage. When a zero crossing is not occurring, this is indicated by causing the output 52 to be at a logic high level, at about +5VDC. When a zero crossing occurs on the AC line voltage at 54, the logic voltage at the output 52 drops to about 0 VDC, and maintains a pulse width of about 400 μsec, which is a nominal pulse width having extremes in the range of 50 μsec to 600 μsec under the variety of worldwide AC line voltages.

AC line voltages across the world fall within two general ranges. The lower range of extremes is in the numeric value of 90–139 volts RMS, at 47–63 Hz, which generally covers the United States, Canada, Mexico, and Japan. The higher range of AC line voltage extremes covers a numeric value of 180–259 volts RMS, at 47–63 Hz. These larger magnitude voltages cover most of Europe, Australia, and numerous other countries.

The incoming AC line voltage at 54 is rectified by diodes D23 and D24, which function as a full wave rectifier. The voltage at the cathode end of D23 and D24 will be a full wave rectified sine wave, having a voltage peak that is approximately the square root of 2 times the AC RMS line voltage. A resistor R52 pulls the cathodes to ground when the AC line voltage goes to zero and the diodes D23 and D24 are not conducting. The resistor R51 serves as a current limiting and voltage dropping resistor.

When the AC line voltage is two diode drops (about 1.4 volts) above a reference voltage (illustrated as "REF" on FIG. 2), a current flows through R51 and D22 to charge a capacitor C15. In conjunction with a zener diode D27, the charging of capacitor C15 creates a local +18 VDC power supply reference to the node REF. If the current delivered to C15 causes its voltage to exceed the zener voltage of zener diode D27, then the zener diode will absorb sufficient current to keep the voltage at the zener's voltage rating of 18 VDC.

The +18 VDC rail is supplied to the collector of a darlington PNP transistor Q6. When a zero crossing of the AC line voltage occurs, the voltage at the collector of Q6 is greater than that of the base of Q6, thereby turning Q6 ON. When a zero crossing is not present, the voltage at the base of Q6 is greater than that of the collector of Q6, which thereby keeps Q6 turned OFF. During a zero crossing, Q6 conducts current which flows through an LED of an optoisolator U8. When current flows through U8's LED, U8's phototransistor begins to conduct and will eventually turn ON during the zero crossing. When the phototransistor of U8 conducts, its collector output is clamped to a low voltage of approximately to 0 volts DC, and the output voltage at 52 drops to a Logic 0. This is the negative-going pulse during an indication of a zero crossing. If the phototransistor is not conducting, the output at 52 is pulled up to +5 VDC through a pull-up resistor R58.

Figure 3:
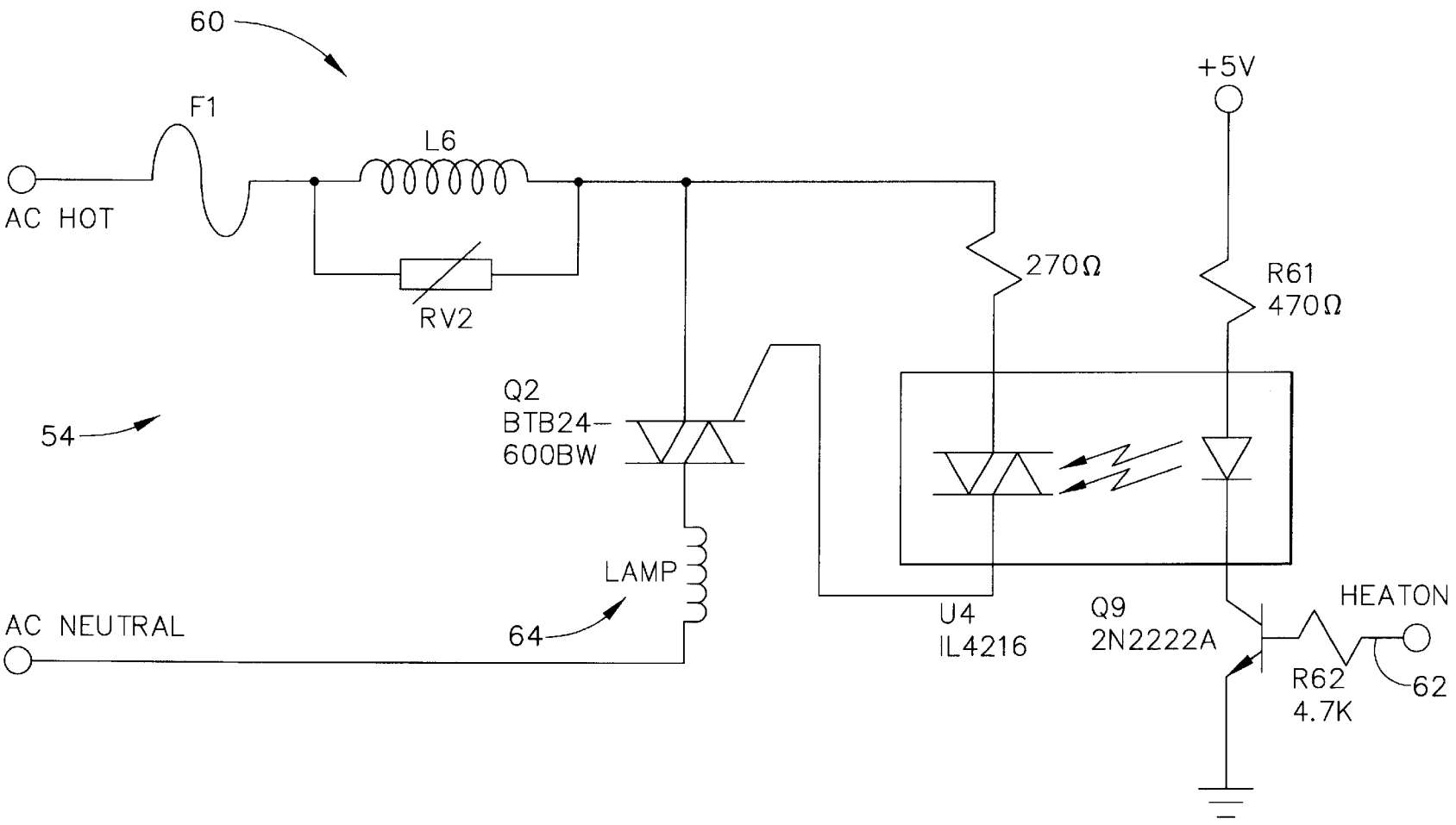
FIG. 3 is a schematic diagram of the electrical components of a lamp control circuit, as constructed according to the principles of the present invention.

FIG. 3 illustrates the electrical and electronic components of lamp control circuit 60 in a schematic diagram format. These components and their individual operations will be discussed before describing the methodology behind the varying of the power output provided to the lamp 64. AC line voltage is delivered at 54 to the terminals marked "AC Hot" and "AC Neutral." A fuse F1 is used to limit current in case of a fault, such as a short in the triac Q2 to AC ground. The preferred triac is manufactured by SGS Thomson, part number BTB24-600BW, in a TO-220 package.

When the triac is turned ON, current is supplied to lamp 64 by applying a voltage signal to the gate input of triac Q2, which is generated by an optoisolator U4. Optoisolator U4 preferably is a part number IL4216, manufactured by Siemens, and is used as a "phase control" interface. The signal from U4 to the gate of Q2 is activated by energizing the triac output of U4, which occurs when the LED side of optoisolator U4 is appropriately energized.

The LED input side of U4 is energized when an NPN transistor Q9 is turned ON, which preferably is a part number 2N2222A device. Q9 is turned ON by applying a logic high level signal (at about 5 VDC) to the input node called "HEATON" at 62. When the Logic 1 signal is applied at HEATON, a resistor R62 limits the current to the base of Q9 to a proper value. When this occurs, Q9 turns ON, and current flows from a +5 VDC supply through Q9, and is limited to a proper value by a resistor R61, thereby turning ON the LED input of U4.

For electromagnetic compatibility purposes, a voltage limiting device "RV2" and a "small" inductor L6 are placed between the fuse F1 and the triac Q2. RV2 preferably is a metal oxide varistor, or an equivalent device, that begins to clamp any voltage spike that increases above 200 to 300 volts, and turns ON hard if the voltage rises all the way to about 400 volts. This is desirable in order to protect the preferred triac Q2 which has a 600 volt AC rating. The inductor L6 preferably has a value of about 1 mH, and has a physical size of about 25 mm diameter and 10 mm thickness. This is a very much smaller inductor than is used in conventional phase-angle control circuits, which have a rating of about 30 mH to 40 mH, and have a physical size of about 75 mm diameter and 20 mm thickness.

The tungsten halogen lamp 64 will preferably provide a wattage output in the range of 500 W to 850 W, depending upon the exact needs of a particular laser print engine. One exemplary tungsten halogen lamp is manufactured by Ushio America, Inc., and is used on a Lexmark laser printer model OPTRA® S 2455, which uses a 750 W rated lamp.

The control method of the present invention combines conventional ON-OFF control and phase-angle control to reduce the AC inrush current to the tungsten halogen lamp, so that the circuit can satisfy both the European flicker and European harmonic requirements, while also eliminating the large in-series inductor. As described hereinabove, the conventional ON-OFF control causes light flicker but does not cause a harmonic problem, whereas the conventional phase-angle control may fix a light flicker problem but then results in AC harmonics that must be attenuated by the large inductor.

The present invention overcomes both problems by applying phase-angle control for a very short time period when the lamp is initially turned ON, and then the control circuit quickly switches from phase-angle control to standard ON-OFF control to reduce the harmonics generated by phase-angle control methodologies. By using the present invention, the tungsten halogen lamp has three states: (1) power full OFF, (2) power ramp-up, and (3) power full ON. Since the lamp is turned on in order to heat the fuser, the actual temperature of the fuser is measured by the thermistor circuit 40 (see FIG. 1). When the fuser temperature requires more heat, the lamp state cannot be directly transferred from power full OFF state to power full ON state. Instead, when the lamp is turned on from a cold start, the lamp state changes from power full OFF to power ramp-up by using the phase-angle ramping control methodology of the present invention.

During the power ramp-up state, power supplied to the lamp is adjusted by delaying the firing pulse relative to the start of each AC half cycle. Depending upon whether or not the fusing temperature limit has been reached, the lamp state can be changed from either power ramp-up to power full ON, or from power ramp-up to power full OFF. If the fuser temperature limit has not been reached during the power ramp-up state, the lamp will be turned full ON to reach and maintain its fusing temperature under ON-OFF control. On the other hand, if the fusing temperature limit is achieved during either power ramp-up or during the power full ON state, the lamp will be immediately turned OFF to reduce temperature overshoot.

An exemplary generic computer program that could be used by microprocessor 30 is provided immediately below:

```
If(fuser roll temperature is equal to or lower than the lower temperature bound) Then
        If      (Lamp_Power_State is Power_Full_Off) Then
                Set Power_Supplied_To_Lamp equal to Power_Increment
                Turn on lamp with the power specified by Power_Supplied_To_Lamp
                Set Lamp_Power_State to Power_Ramp_Up
        Else
                If(Lamp_Power_State is Power_Full_On) Then
                        Turn on lamp with Full_Power
                Else
                        If(Power_Supplied_To_Lamp+Power_Increment is greater than Full_Power) Then
                                Set Power_Supplied_To_Lamp equal to Full_Power
                                Turn on lamp with the power specified by Power_Supplied_To_Lamp
                                Set Lamp_Power_State to Power_Full_On
                        Else
                                Power_Supplied_To_Lamp=Power_Supplied_To_Lamp+Power_Increment
                                Turn on lamp with the power specified by Power_Supplied_to Lamp
                        End if
                End if
        End if
Else
        If(fuser roll temperature is equal to or higher than the upper temperature bound) Then
                Turn off lamp
                Set Lamp_Power_State to Power_Full_Off
        Else
                If(Lamp_Power_State is Power_Full_Off) Then
                        Keep lamp off
                Else
                        If(Lamp_Power_State is Power_Full_On) Then
                                Turn on lamp with Full_Power
                        Else
                                If(Power_Supplied_To_Lamp+Power_Increment is greater than
                                Full_Power) Then
                                Turn on lamp with Full_Power
                                Set Lamp_Power_State to Power_Full_On
```

-continued

```
                    Else
                        Power_Supplied_To_Lamp=Power_Supplied_To_Lamp+Power_Increment
                        Turn on lamp with the power specified by Power_Supplied_to Lamp
                    End if
                End if
            End if
End if
```

It is important to carefully select the amount of time that will elapse during the power ramp-up state of the lamp 64. This phase-angle control methodology during the power ramp-up state must be of sufficient time duration to reduce the amount of flicker to pass the European flicker test. However, this power ramp-up time interval must also be as short as possible to keep the harmonics as small as possible for a printer or other device, without the requirement of adding a large AC current harmonic attenuation inductor, which would otherwise be needed to pass the European harmonic test. While this methodology of the present invention is specifically aimed at European electrical equipment standards, it can be used for any AC powered device, regardless of the input voltage RMS value or the operating frequency of the AC line current. For the purposes of this description, details will be provided for both a 50 Hz system and a 60 Hz system.

The main purpose of the above computer program is to gradually supply power to the lamp at times when the lamp filament is relatively cold, and then to preheat the lamp filament during the power ramp-up, which will have the effect of increasing the filament resistance (and temperature) to its steady state value. Once the filament resistance reaches its steady state value, full power is applied to the lamp until the fuser roll temperature reaches its upper limit, after which power is turned completely OFF to reduce temperature overshoot. Depending upon lamp wattage and the power supplied to the lamp, it usually takes several hundred milliseconds to perform the ramp-up step of the methodology of the present invention.

During the ramp-up step, phase-angle control is used to control the amount of power supplied to the lamp, so that the lamp can be turned on slowly to reduce the inrush current. Initially, a small amount of power is supplied to the lamp to warm up the filament and increase its resistance by use of a large time delay for the firing pulse signal. In other words, after a zero crossing of the AC sine wave, there is a relatively large time delay before the HEATON signal at 62 is provided to Q9, which will ultimately turn on the triac Q2 that supplies current to the lamp 64. After the initial half cycle of the AC sine wave, power is gradually increased by reducing the time delay at each successive AC half cycle. After the lamp filament reaches a steady state resistance, full power is applied to the lamp by reducing the delay time to zero. An example of these signals is provided in FIG. 4.

Figure 4:
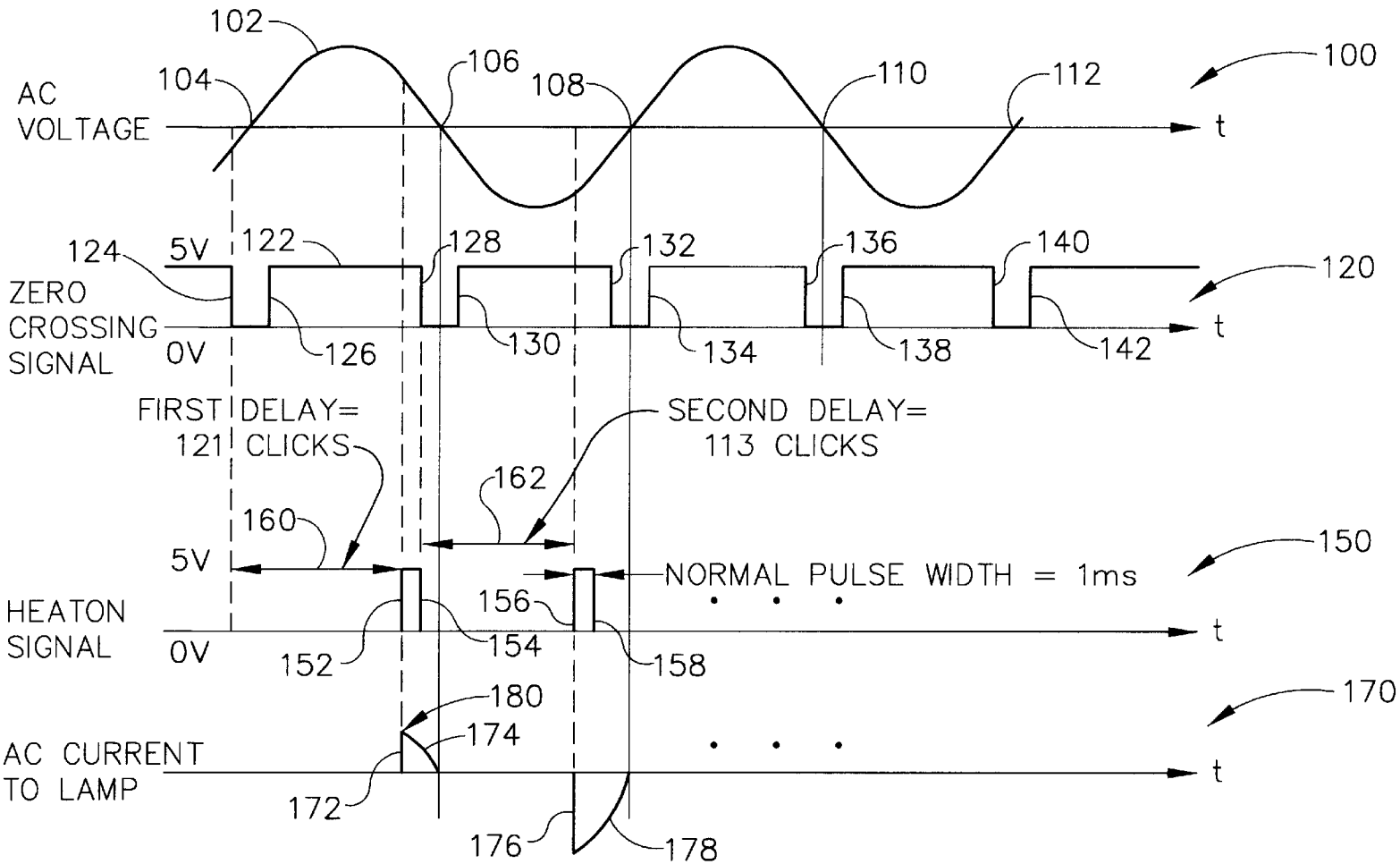
FIG. 4 is a graph of various signals that are generated in the zero crossing detector and lamp control circuit of FIGS. 2 and 3.

On FIG. 4, a graph 100 depicts the AC sine wave at 102, which exhibits zero crossings at 104, 106, 108, 110, and 112. A graph 120 illustrates the zero-crossing signal generally at the curve 122, and this curve 122 represents the signal waveform for the output signal at 52 on FIG. 2. As can be seen on the graph 120, this curve starts at 5 VDC and then falls at 124 to 0 VDC. This falling edge occurs because the AC sine wave voltage approaches a zero crossing at 104. A short time after the zero crossing has occurred, the voltage of the zero crossing signal rises at an edge 126.

The voltage waveform at 122 remains at +5 VDC until the next zero crossing at 106 is approached, at which time the voltage falls at an edge 128, and then later rises again at an edge 130. This type of waveform continues for each of the remaining zero crossings on the graph 100, as can be seen on the graph 120 at the falling edges 132, 136, and 140, and the rising edges at 134, 138, and 142.

The zero crossing signal 52 is used to initiate a firing pulse under phase-angle control. When the rising edge of zero crossing signal 52 is detected (e.g., at rising edges 126, 130, 134, etc.), a counter starts counting down under the control of microprocessor 30. When the counter reaches zero, a firing pulse will be initiated within 50 microseconds to turn on lamp 64. The time delay provided by this down-counter controls the amount of power supplied to the lamp 64. The numeric amount of counts that must be counted down is determined by the contents of the FUSDELAY register 22 that is part of the ASIC 20.

The above computer program preferably runs repetitively at intervals of about every 10 msecs. According to the power specified by the computer program for the next AC half cycle, a desired delay count is set into the ASIC's FUSDELAY register 22. When a zero crossing is detected, the contents of the FUSDELAY register are loaded into a down-counter, and the counter counts down at a predetermined rate (versus time) until it reaches zero, at which time a firing pulse is generated at the HEATON signal 62 to turn on the lamp. As described above, a full AC half cycle delay produces zero power, and a zero half cycle delay yields full power. By loading the FUSDELAY register 22 with a sufficiently large number, which is then transferred to the down-counter, the first half cycle will produce approximately zero power (or very little power), and then the delay time before the firing pulse is provided is gradually reduced for each successive half cycle of the AC sine wave. Finally, when the delay is reduced to zero, full power is achieved.

It will be understood that the down-counter discussed hereinabove preferably is a register within the ASIC 20, although a separate hardware counter could be used without departing from the principles of the present invention.

To achieve the best printer performance, two different power ramp-up profiles are used for different printer machine states. These states are "standby" and "printing." In the printing state, the fuser temperature response is sufficiently critical, especially when printing on heavy print media in cold and wet environments, that the power supplied to the lamp must be increased quickly enough to achieve a satisfactory temperature response. Therefore, the ramp-up time in the printing state of the present invention is achieved very quickly, at least in comparison to the ramp-up time interval for the standby state.

In describing the FUSDELAY register 22 and the down-counter, a unit of time called a "click" is defined as being equal to 68.69 microseconds. If the AC line frequency is determined to be 50 Hz, then the initial phase delay for the first half cycle is set to 150 clicks, which provides a delay of 10.3 msecs, which is 300 microseconds longer than a half cycle at 50 Hz. If the frequency is determined to be 60 Hz, the initial phase delay is set to 121 clicks, which provides a delay of 8.31 msecs, which is 23 microseconds shorter than a half cycle of a nominal 60 Hz period.

If the AC line frequency is determined to be between 45 and 55 Hz, the line frequency is declared to be at 50 Hz. If the AC line frequency is between 55 and 65 Hz, the AC line frequency is declared to be at 60 Hz.

Using the initial delay selection of either 150 clicks (at 50 Hz) or 121 clicks (at 60 Hz), the zero crossing signal 52 is monitored while waiting for the next zero crossing event. When the falling edge of the zero crossing signal 52 is detected, the system essentially waits for either 150 or 121 clicks (by inspecting the output of the down counter that was loaded with the contents of the FIJSDELAY register 22), and then a 1 msec duration HEATON pulse is issued to turn on the triac Q2. If a zero crossing occurs while the HEATON pulse is active, then the HEATON signal 62 is turned off. The graphs 150 and 170 on FIG. 4 illustrate the signals during the first half cycle. Using a 60 Hz example, the first delay at 160 is provided as being 121 clicks in duration. This results in a rising edge of the HEATON signal at 152, with only a very short duration before it falls at an edge 154. The AC current to the lamp is illustrated at the graph 170, and it has a rising edge at 172 which corresponds in time with the rising edge 152 of the HEATON signal. Since the sine wave at this point in the waveform exhibits a negative slope, the waveform of the graph 170 immediately falls at 174 until it reaches zero, which corresponds in time to the zero crossing 106 of the graph 100. The peak value at 180 of this AC current to the lamp is equal to the instantaneous voltage divided by the resistance of the circuit, which mainly consists of the resistance of the tungsten halogen lamp filament.

After the first HEATON pulse is issued, the phase delay is decremented by eight (8) clicks for the next 10 msec interval if the printer is in the "standby" state. Since the initial delay was given at 121 clicks (for the 60 Hz example), during the next 10 msec interval this delay is decremented to 113 clicks. This results in a time delay given at the reference numeral 162 on the graph 150. The result is a HEATON signal with a rising edge at 156, and a falling edge at 158 that occurs about 1 msec later.

The resulting current to the lamp on the graph 170 shows a negative-going falling edge at 176 which corresponds in time to the rising edge 156 of the HEATON signal. Since this occurs after a shorter time delay than in the first AC half cycle, a larger portion of the AC sine wave will be provided to the filament of the lamp. The energized portion of the AC waveform will exhibit a sine curve shape, as can be seen at 178 on the graph 170. It can be easily seen that the second half cycle of the sine curve 102 allows more power to be transmitted to the filament of the lamp 64, at least as compared to the first half cycle. This process is repeated until the lamp is on at full power.

In the above example, the phase delay was decremented by eight (8) clicks at each 10 msec interval. It will be understood that the decrementing of the phase delay could be either more or less than eight (8) clicks per 10 msec interval, and furthermore that the temperature control computer program could run at a different interval than 10 msec. As an example, at 60 Hz, the computer program could run at an interval of 8.33 msec, which would directly correspond to a single half cycle of the AC sine wave. In that event, the temperature control computer program would be making a decision with regard to the amount of phase delay almost exactly in correspondence with a single AC half cycle.

It will also be understood that the 10 msec control interval that is preferred in the above-described computer program directly corresponds with a half cycle of an AC sine wave at 50 Hz. Again, this time interval for the computer program control could be more or less than 10 msec for its control interval, and furthermore the amount of decrementing the phase delay could be more or less than eight (8) clicks per control interval.

As briefly described hereinabove, two different power ramp-up profiles are used for the "standby" machine state and the "printing" machine state. The decrementing by eight (8) clicks every 10 msec is the preferred change in the phase-angle delay for the printing state, however, in the standby state there is less need to quickly ramp-up the power from zero to full power, because the temperature response for standby is not as critical as that for printing, and a slower ramp-up will produce even less flicker. In standby, the print engine computer program will load the FUSDELAY register 22 with the same 121 delay clicks when it is time to turn on the lamp 64, however, instead of decrementing the number of delay clicks by eight (8) for each 10 msec interval, it is preferred to decrement the number of delay clicks per interval by approximately three (3) clicks for every two (2) control intervals. It is preferred that this is done by indexing through a table of the following values: [2,1,2,1,2,1,2,1, . . . ] until the delay becomes zero (0) clicks, which is equivalent to full power. By using this table as the source of the amount of clicks that are decremented from the original value of 121, the following values will be applied for successive 10 msec control intervals: for the first interval, 121 clicks initial phase delay (which is equivalent to zero power); for the second interval, 119 clicks phase delay; for the third interval, 118 clicks phase delay; and so on, in which the pattern would continue to 116 clicks, 115 clicks, 113 clicks, etc. until reaching zero clicks.

By use of the ramp-up profiles described hereinabove, in the printing state the time of ramping up power from zero to full power requires about 160 msec, which generates about 75% flicker of the European flicker limit. In the standby mode, it requires about 810 msec to ramp-up power from zero to full power, and the flicker generated is approximately 55% of the European flicker limit.

By use of the methodology of the present invention, the function of a dimmer switch is essentially duplicated, but at a controlled rate that allows the electrical load to meet both the European harmonic requirement and the flicker requirement. Since the lamp is energized in a full ON condition most of the time (except, of course, when ramping up to full power), the high harmonic currents are avoided, which therefore does not require a large inductor.

If the AC line frequency is 50 Hz, for example, then it is preferred to load a value of 150 clicks into the FUSDELAY register 22 for the initial phase delay value. As noted above, if the value of 68.69 microseconds per click is used, the delay caused by 150 clicks is equivalent to about 10.3 msec, which is just longer than a single half cycle of the 50 Hz sine wave period. If the same decrementing routine is used, the phase delay will be reduced by eight (8) clicks every 10 msec, and the decrementing process for a power ramp-up period will require approximately 190 msec during a printing mode. Naturally, if a similar program is used in the standby mode, it will require even more time if 150 clicks are used as compared to the 121 clicks example described above, for a 60 Hz AC line voltage sine wave.

The power ramp-up interval is also referred to as the "power increment time." There are two other time quantities that must be considered with respect to the European standards, and are referred to as a "harmonic time limit" and a "flicker time limit." For a printer without a large AC harmonic attenuation inductor to be able to pass the European harmonic test, the power increment time must be smaller than the harmonic time limit. The harmonic time limit thus represents an upper bound of the power increment time, and this harmonic time limit is determined by the European harmonic standard, the lamp wattage, and the fuser's operating temperature.

The flicker time limit serves as a lower bound of the power increment time, since a printer having a power increment time that is shorter in duration than the flicker time limit will fail to pass the European flicker test. The flicker time limit also is determined by the lamp wattage and fuser's operating temperature, as well as the European flicker standard.

The flicker time limit is determined for any particular piece of electrical or electronic equipment by the following procedure:

(1) The power increment time is set to a relatively small value, the European flicker test is performed, and the flicker generated by the device under test is then measured;

(2) If the power increment time value fails to pass the flicker test in step (1), increase the power increment time value and run the flicker test again. If the power increment test passes the flicker test this time, then decrease the power increment time value and again run the flicker test for the updated power increment time value;

(3) Repeat step (2) above, to determine an estimate or the actual flicker time limit.

To determine the harmonic time limit for a particular electrical or electronic device, perform the following procedure:

(1) Set the power increment time to a relatively small value, perform the European harmonic test, and measure the harmonics generated by the device under test;

(2) If the power increment time value fails to pass the harmonic test in step (1), decrease the power increment time value and run the harmonic test again. If the power increment time value passes the harmonic test this time, increase the power increment time value and run the harmonic test for the updated power increment time value;

(3) Repeat step (2) above, to determine the harmonic time limit or an estimate of the harmonic time limit.

Figure 5:
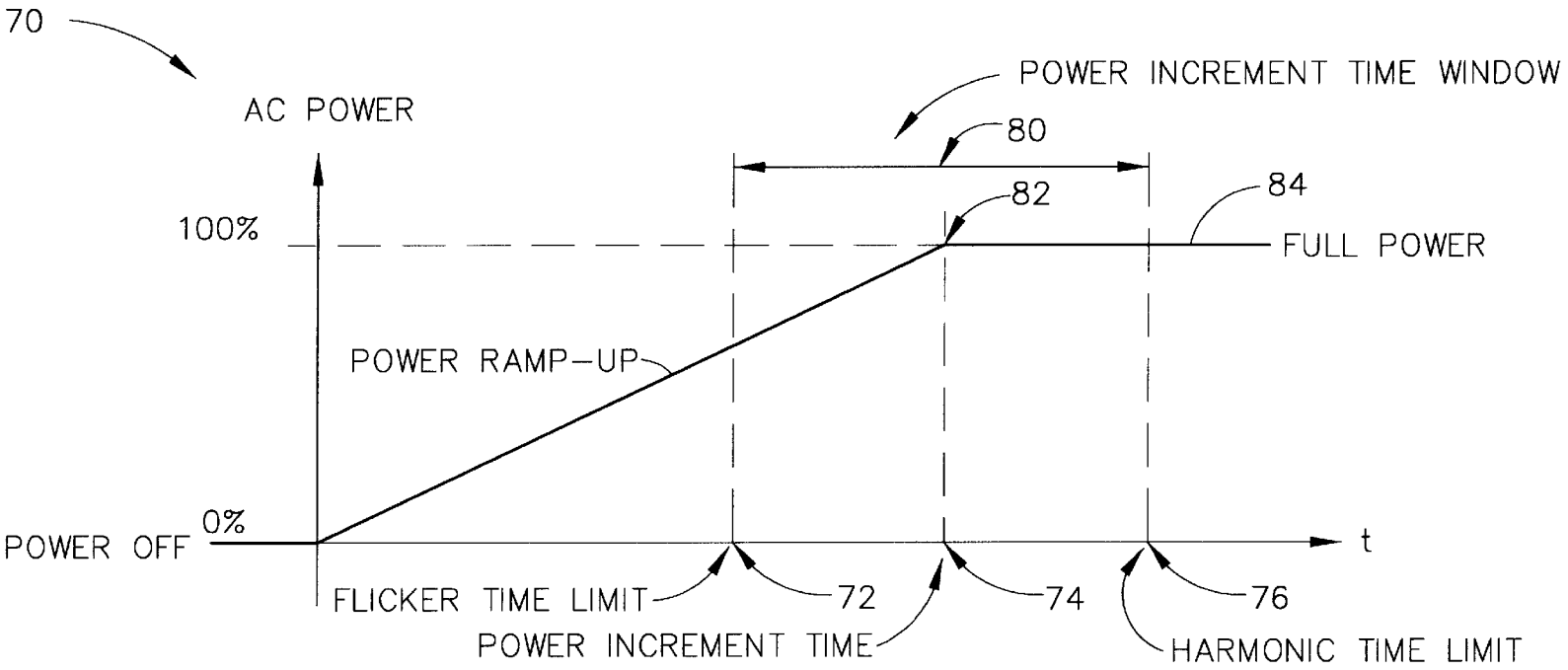
FIG. 5 is a graph of a preferred power ramp-up and full power cycle, as related to the present invention.

By inspecting the graph 70 on FIG. 5, it can be seen that a power increment time window designated by the reference numeral 80 exists between the flicker time limit 72 and the harmonic time limit 76. It must be true that the value of the harmonic time limit must be greater than the value of the flicker time limit, so that a power increment time window actually exists and that the window length is greater than zero. Otherwise, the power increment time window does not exist.

The length of the power increment time window 80 will vary for different models of electrical and electronic equipment, including different models of laser printers. If the power increment time window exists for a particular apparatus, it means that this apparatus can be manufactured without a large AC harmonic attenuation inductor and still pass the European flicker and harmonic test, so long as the power increment time is set to be within the window. On FIG. 5, the power increment time is positioned at the reference numeral 74, which means that the power ramp-up mode of operation should increase the power from 0% to 100% (or full ON) such that the 100% value is reached at the point designated by the reference numeral 82. Once the full power value is reached, then full 100% power is continued along the line 84 on the graph of FIG. 5.

The equipment designer must now also determine the exact point within the power increment window that is to be chosen as the power increment time. This depends upon whether or not the fuser temperature response is required to be very fast for satisfactory fusing grade, and also the size of the flicker margin and harmonic margin that is desired. For example, if either the flicker or harmonic margin is too small, the device may fail to pass a European flicker or harmonic test because of variations in either the device under test or the test equipment itself.

If the fuser temperature response is not critical for the points within the power increment window, then it is preferred that the midpoint of the power increment window be chosen as the power increment time. This will provide enough flicker and harmonic margin if the power increment time window is large enough. On the other hand, if the fuser temperature response is critical, such as when printing heavy print media in cold and wet environments, then a point closer to the flicker time limit (within the power increment time window) can be selected as the operating point for the power increment time. This will allow the power to increase quickly enough to achieve a satisfactory temperature response, but still satisfy the European flicker requirement.

Some exemplary laser printers have been tested for the European flicker and harmonic requirements, under different conditions as listed in the Table #1, immediately below:

| Laser Printer | Harmonic Inductor | Source Voltage | Power Increment Time | Flicker Test | Harmonic Test | Test Equipment |
|---|---|---|---|---|---|---|
| Model #1 | No | 200 V | 800 ms | 62%, Passed | Passed | Voltech |
| Model #1 | No | 230 V | 800 ms | 58%, Passed | Passed | Voltech |
| Model #1 | No | 260 V | 800 ms | 65%, Passed | Passed | Voltech |
| Model #1 | No | 230 V | 800 ms | 57%, Passed | 61%, Passed | HP |
| Model #2 | No | 210 V | 800 ms | 55%, Passed | Passed | Voltech |
| Model #2 | No | 230 V | 800 ms | 57%, Passed | Passed | Voltech |
| Model #2 | No | 255 V | 800 ms | 55%, Passed | Passed | Voltech |
| Model #2 | No | 210 V | 150 ms | 73%, Passed | Passed | Voltech |
| Model #2 | No | 230 V | 150 ms | 75.4%, Passed | Passed | Voltech |

-continued

| Laser Printer | Harmonic Inductor | Source Voltage | Power Increment Time | Flicker Test | Harmonic Test | Test Equipment |
|---|---|---|---|---|---|---|
| Model #2 | No | 255 V | 150 ms | 77.6%, Passed | Passed | Voltech |
| Model #2 | No | 230 V | 800 ms | 57%, Passed | 53%, Passed | HP |

As can be seen by viewing the results of Table #1, for the laser printer denoted as Model #2, the flicker increases from about 55% to about 75% of the European flicker limit if the power increment time decreases from 800 millisecond to 150 millisecond. Even at the 150 millisecond power increment time, the design of the present invention provides a flicker margin of about 25% of the European flicker limit. For Model #2, the worst harmonic test result is about 53% of the European harmonic limit, which provides a 47% margin for Model #2. The worst harmonic test result for Model #1 is about 61%, which provides a harmonic margin of about 39% of the European harmonic limit.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A method for controlling alternating current (AC) provided to an electrical device, said method comprising:

A. providing a source of alternating current electrical power;

B. providing an alternating current zero crossing detector, a phase-angle control circuit, an electrical load, and a main controller;

C. entering a power ON mode for said electrical load, by:

(i) after detecting an initial zero crossing of said alternating current electrical power, applying, under the control of said main controller, a small amount of alternating current to said electrical load by way of said phase-angle control circuit by: loading a counter with an initial numeric value, counting down from said initial numeric value until said counter reaches a value of zero, and turning on an alternating current switching device to switch said source of alternating current electrical power to said electrical load until the next zero crossing;

(ii) after subsequent zero crossings, gradually increasing said amount of alternating current to said electrical load in a manner to achieve full power by repeatedly loading said counter with a lesser numeric value, and after detecting each of said subsequent zero crossings: counting down from said lesser numeric value until said counter reaches a value of zero, turning on said alternating current switching device to switch said source of alternating current electrical power to said electrical load until the next zero crossing, to thereby smoothly ramp-up said amount of alternating current being supplied per half-cycle of AC until full power is achieved;

(iii) once achieving full power, continuing to apply said full power to said electrical load until a power OFF command is generated by said main controller; and D. entering a power OFF state for said electrical load, by removing said alternating current to said electrical load.

2. The method as recited in claim 1, wherein applying said small amount of alternating current to said electrical load comprises: delaying for nearly an entire half cycle of AC a first impulse of alternating current to said electrical load; and wherein gradually increasing said amount of alternating current comprises: decreasing a time delay at a predetermined rate, during each subsequent half cycle of AC, before providing an impulse of alternating current to said electrical load.

3. The method as recited in claim 2, wherein delaying a first impulse of alternating current comprises: loading said counter with a numeric value that represents a time interval nearly equal to an entire half cycle of AC; and wherein decreasing a time delay at a predetermined rate comprises: loading said counter with a predetermined lesser numeric value that represents a time interval corresponding to said time delay, for each subsequent half cycle of AC, until said lesser numeric value is equal to zero, corresponding to full power.

4. The method as recited in claim 3, further comprising loading said counter with a numeric value of zero for all subsequent half-cycles of AC after full power has been achieved, until said power OFF state is entered.

5. The method as recited in claim 4, wherein a difference in numeric values repeatedly loaded into said counter, upon subsequent half-cycles of AC, changes at a first ramp-up rate when said electrical device is operated in a normal mode, and changes at a second, lesser ramp-up rate when said electrical device is operated in a standby mode.

6. The method as recited in claim 4, wherein said alternating current switching device comprises a triac.

7. The method as recited in claim 4, wherein full power is achieved after a number of half-cycles of AC that falls between a flicker time limit and a harmonic time limit.

8. The method as recited in claim 4, wherein said power OFF mode of operation is directly entered into regardless of whether the instant power level is at full power or is being increased at one of the ramp-up rates.

9. An electrically-powered apparatus, comprising:

A. a memory circuit for storage of data, said memory circuit containing a first register and a down-counter;

B. an alternating current zero crossing detector;

C. a phase-angle control circuit;

D. an electrical load; and

E. a processing circuit that is configured to control a mode of operation of said electrical load, including an OFF-mode, a partial-ON-mode, and a full-ON-mode, by:

(i) entering said partial-ON-mode for said electrical load, wherein:

a. after said alternating current zero crossing detector detects an initial zero crossing of said alternating current electrical power, applying a small amount of alternating current (AC) to said electrical load by way of said phase-angle control circuit, said amount of alternating current being proportional to a count value stored by said processing circuit into said first register; wherein said count value of said first register is initially transferred into said down-counter by said processing circuit; and after each zero crossing while in said partial-ON-mode, said down-counter counts down until reaching a value of zero, after which said phase-angle control circuit provides a firing pulse to an output triac that turns on and energizes said electrical load, and said output triac remains turned on until reaching the next zero crossing;

b. after subsequent zero crossings, gradually increasing said amount of said alternating current to said electrical load in a manner to achieve full power so as to satisfy a European flicker requirement and to satisfy a European harmonic requirement;

(ii) entering said full-ON-mode upon achieving full power, and continuing to apply said full power to said electrical load until said processing circuit determines it is time to go into a power OFF mode; and (iii) entering said power-OFF-mode, by removing said alternating current to said electrical load.

10. The electrically-powered apparatus as recited in claim 9, wherein said count value of said first register is decreased after each AC half cycle, thereby repeatedly decreasing a time interval between a subsequent zero crossing and when said phase-angle control circuit provides a firing pulse to said output triac that turns on and energizes said electrical load, until said count value of said first register reaches zero, thereby achieving full power.

11. The electrically-powered apparatus as recited in claim 9, wherein said electrical load comprises a tungsten halogen lamp.

12. The electrically-powered apparatus as recited in claim 9, wherein said electrically-powered apparatus comprises a laser printer, and said electrical load comprises a fuser electrical heating element.

13. The electrically-powered apparatus as recited in claim 12, further comprising a temperature sensor and an analog-to-digital converter; wherein said temperature sensor measures a fusing temperature of said laser printer and creates an analog voltage signal that is connected to an input of said analog-to-digital converter; an output of said analog-to-digital converter creates a digital signal that is connected to said processing circuit; and wherein said partial-ON-mode is entered when said fusing temperature falls below a first predetermined level, and said power-OFF-mode is entered when said fusing temperature rises above a second predetermined level.

14. A method for controlling alternating current (AC) provided to a fuser electrical heating element of an image forming apparatus, said method comprising:

A. providing a source of alternating current electrical power;

B. providing a print engine having an alternating current zero crossing detector, a phase-angle control circuit, a fuser electrical heating element, and a main controller;

C. energizing said fuser electrical heating element upon entering a printing mode of operation, by:

(i) after detecting an initial zero crossing of said alternating current electrical power, applying a small amount of alternating current to said fuser electrical heating element by way of said phase-angle control circuit, said amount of alternating current being under the control of said main controller;

(ii) after subsequent zero crossings, gradually increasing said amount of alternating current to said fuser electrical heating element at a first relatively quick ramp-up rate, yet in a manner to achieve full power so as to satisfy a European flicker requirement and to satisfy a European harmonic requirement;

(iii) once achieving full power, continuing to apply said full power to said fuser electrical heating element until a power OFF command is generated by said main controller;

D. energizing said fuser electrical heating element upon entering a standby mode of operation, by:

(i) after detecting an initial zero crossing of said alternating current electrical power, applying a small amount of alternating current to said fuser electrical heating element by way of said phase-angle control circuit, said amount of alternating current being under the control of said main controller;

(ii) after subsequent zero crossings, gradually increasing said amount of alternating current to said fuser electrical heating element at a second relatively slow ramp-up rate, yet in a manner to achieve full power so as to satisfy a European flicker requirement and to satisfy a European harmonic requirement;

(iii) once achieving full power, continuing to apply said full power to said fuser electrical heating element until a power OFF command is generated by said main controller; and E. de-energizing said fuser electrical heating element, from either of said printing mode and said standby mode of operation, upon entering a power OFF mode of operation.

15. The method as recited in claim 14, wherein applying said small amount of alternating current to said fuser electrical heating element comprises: delaying for nearly an entire half cycle of AC a first impulse of alternating current to said fuser electrical heating element; and wherein gradually increasing said amount of alternating current comprises: decreasing a time delay at a predetermined rate, during each subsequent half cycle of AC, before providing an impulse of alternating current to said fuser electrical heating element.

16. The method as recited in claim 15, wherein delaying a first impulse of alternating current comprises: loading a down-counter with a numeric value that represents a time interval nearly equal to an entire half cycle of AC; and wherein decreasing a time delay at a predetermined rate comprises: loading said down-counter with a predetermined lesser numeric value that represents a time interval corresponding to said time delay, for each subsequent half cycle of AC, until said lesser numeric value is equal to zero, corresponding to full power.

17. The method as recited in claim 14, wherein gradually increasing said amount of said alternating current comprises:

A. loading a counter with an initial numeric value, after detecting a zero crossing counting down from said initial numeric value until said counter reaches a value of zero, and turning on an alternating current switching device to switch said source of alternating current electrical power to said fuser electrical heating element until the next zero crossing;

B. repeatedly loading said counter with a lesser numeric value, after detecting a subsequent zero crossing counting down from said lesser numeric value until said counter reaches a value of zero, and turning on said alternating current switching device to switch said source of alternating current electrical power to said fuser electrical heating element until the next zero crossing, to thereby smoothly ramp-up said amount of alternating current being supplied per half-cycle of AC until full power is achieved; and C. loading said counter with a numeric value of zero for all subsequent half-cycles of AC after full power has been achieved, until said power OFF state is entered.

18. The method as recited in claim 17, wherein the difference in numeric values repeatedly loaded into said counter, upon subsequent half-cycles of AC, changes at a first ramp-up rate when said electrical device is operated in said printing mode, and changes at a second, lesser ramp-up rate when said electrical device is operated in said standby mode.

19. The method as recited in claim 17, wherein said alternating current switching device comprises a triac.

20. The method as recited in claim 17, wherein full power is achieved after a number of half-cycles of AC that falls between a flicker time limit and a harmonic time limit.

* * * * *